US007168891B2

(12) United States Patent
Hartman

(10) Patent No.: US 7,168,891 B2
(45) **Date of Patent: *Jan. 30, 2007**

(54) Z-SHAPED SHEET PILING

(75) Inventor: Richard J. Hartman, Clarence, NY (US)

(73) Assignee: Chaparral Steel Company, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/332,916

(22) Filed: Jan. 17, 2006

(65) Prior Publication Data

US 2006/0115336 A1 Jun. 1, 2006

Related U.S. Application Data

(63) Continuation of application No. 10/995,656, filed on Nov. 23, 2004, now Pat. No. 7,018,140.

(51) Int. Cl.
*E02D 5/08* (2006.01)

(52) U.S. Cl. ..... 405/276; 405/278

(58) Field of Classification Search ..... 405/276, 405/277, 278, 279, 280, 281
See application file for complete search history.

(56) References Cited

U.S. PATENT DOCUMENTS 1,543,676 A * 6/1925 Lindenlauf ..... 405/278
2,128,740 A * 8/1938 Dougherty ..... 405/281
2,332,812 A * 10/1943 Rieger et al. ..... 405/281
5,145,287 A * 9/1992 Hooper et al. ..... 405/262
6,033,155 A * 3/2000 Irvine et al. ..... 405/281
6,106,201 A * 8/2000 Bourdouxhe ..... 405/281
6,190,093 B1 * 2/2001 Bastian et al. ..... 405/278
6,420,014 B1 * 7/2002 Hartman ..... 428/156
6,443,664 B1 * 9/2002 Horan et al. ..... 405/279
2004/0126193 A1 * 7/2004 Moreau ..... 405/274

FOREIGN PATENT DOCUMENTS

EP 367171 * 5/1990

* cited by examiner

*Primary Examiner*—Frederick L. Lagman
(74) *Attorney, Agent, or Firm*—Phillips Lytle LLP

(57) ABSTRACT

A sheet piling (15) comprising a first flange (16), a second flange (18), a web (19), a junction (20) between the first flange and the web, the junction having a substantially concave inner surface (44), the inner surface comprising at least a first concave surface of first radius (23*a*) and a second concave surface of second radius (23*b*). The inner surface may further comprise a third concave surface of third radius (23*c*).

5 Claims, 26 Drawing Sheets

PZ35

PZ35

PZ40

PZ40

PZC21.7

PZC21.7

PZC24.2

PZC24.2

PZC31.8

PZC31.8

PZC39.7

PZC39.7

Z-SHAPED SHEET PILING

CROSS-REFERENCE TO RELATED APPLICATIONS

This application is a continuation of U.S. patent application Ser. No. 10/995,656, filed Nov. 23, 2004 now U.S. Pat. No. 7,018,140.

FIELD OF THE INVENTION

The present invention relates generally to the field of sheet pilings, and more particularly to an improved sheet piling having a substantially Z-shaped transverse cross section.

BACKGROUND ART

A variety of Z-shaped steel sheet pilings are known in the prior art. Z-shaped sheet pilings are typically produced in different sizes characterized by their approximate weight in pounds per square foot ("psf"). Typical sizes include the PZ22, PLZ23, PLZ25, PZ27, PZ35, and the PZ40. Such sheet pilings have been produced by Bethlehem Steel Corporation and United States Steel Corporation.

However, sheet pilings known in the prior art do not provide much versatility with respect to the placement of steel near the junction. This has been found to limit the ability to strengthen the piling with respect to transverse stresses (i.e., those stresses oriented perpendicular to the longitudinal axis of the sheet piling).

Hence, it would be useful to provide sheet pilings which can be manufactured efficiently and with greater selectivity for strength.

DISCLOSURE OF THE INVENTION

With parenthetical reference to the corresponding parts, portions or surfaces of the disclosed embodiment, merely for the purposes of illustration and not by way of limitation, the present invention provides an improved Z-shaped sheet piling (15) comprising a first flange (16), a second flange (18), a web (19), a junction (20) between the first flange and the web, the junction having an inner surface (44), the inner surface defined by at least a first radius (23*a*) and a second radius (23*b*). The inner surface may be further defined by a third radius (23*c*).

The present invention also provides a Z-shaped sheet piling comprising a first flange (16) having a substantially planar flange surface (37), a second flange (18), a web (19) having a substantially planar web surface (39), a junction (20) between the first flange and the web, the junction having a fillet portion (43) defined by the planes of the web surface and flange surface extended (37*a*, 39*a*) to an intersection (59) and an inner substantially arcuate surface (44) intersecting the web surface (60*b*) and flange surface (60*a*), the inner arcuate surface defined by at least a first radius (23*a*) and a second radius (23*b*). The inner arcuate surface may be further defined by a third radius (23*c*).

Accordingly, the general object of the present invention is to provide an improved Z-shaped sheet piling in which the thickness of the web and flange at the junction can be increased more selectively to provide greater strength.

Another object is to provide Z-shaped sheet pilings which are strengthened more selectively.

Another object is to provide improved Z-shape sheet pilings in which steel is extended at the junction along the web or flange in a more case specific manner.

These and other objects and advantages will become apparent from the foregoing and ongoing written specification, the drawings, and the appended claims.

DESCRIPTION OF PREFERRED EMBODIMENTS

Figure 1:
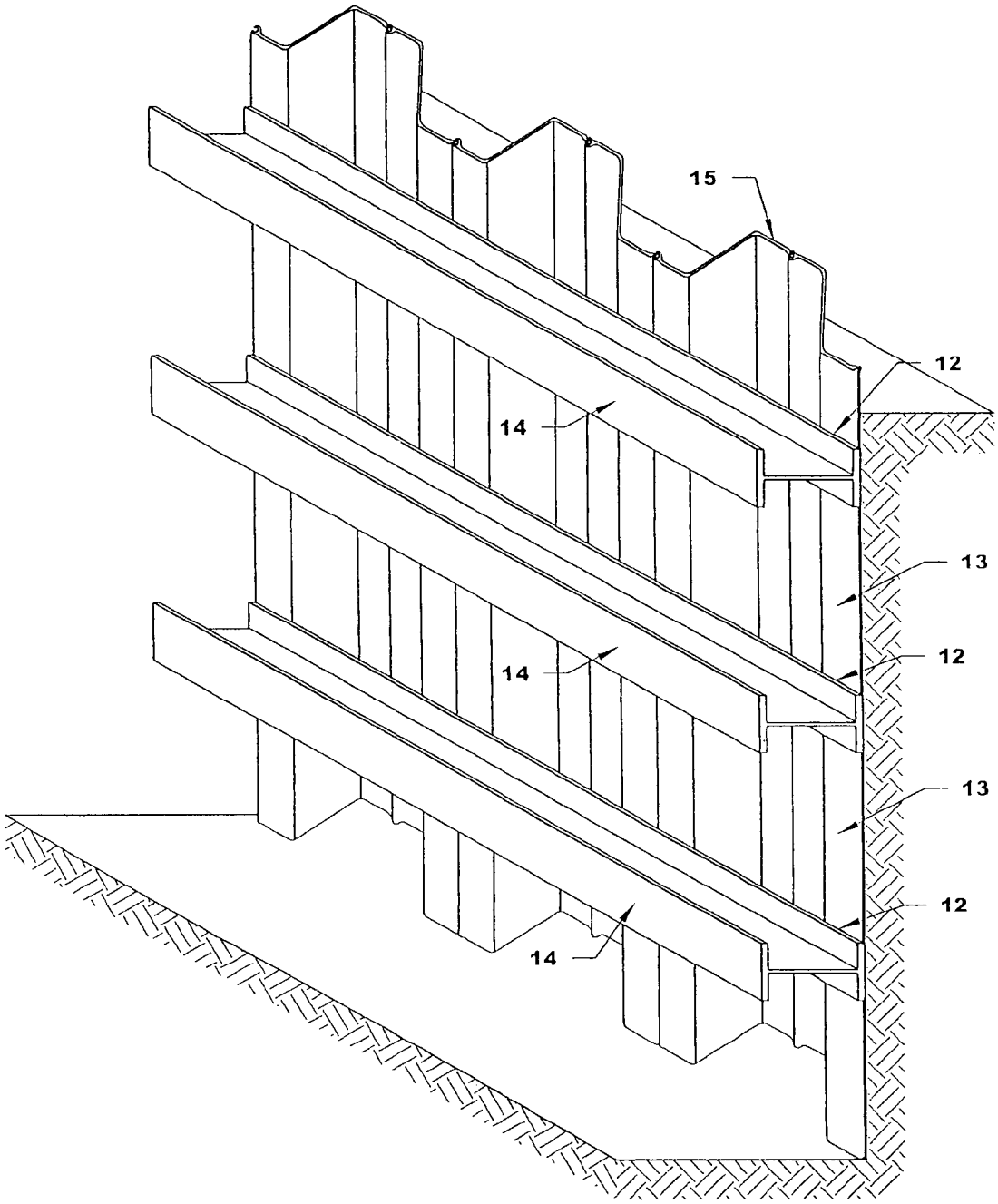
FIG. 1 is a perspective view of the improved sheet piling under loading conditions.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, debris, etc.) together with the specification, and are to be considered a portion of the entire written description of this invention. As used in the following description, the terms "horizontal", "vertical", "left", "right", "up" and "down", as well as adjectival and adverbial derivatives thereof, (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 3:
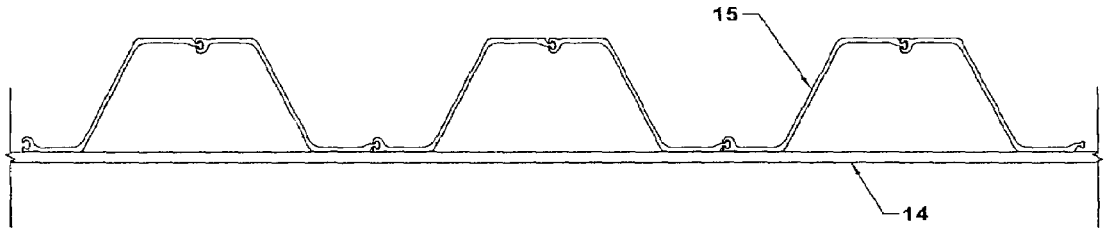
FIG. 3 is a plan view of the sheet piling shown in FIG. 1.
Figure 4:
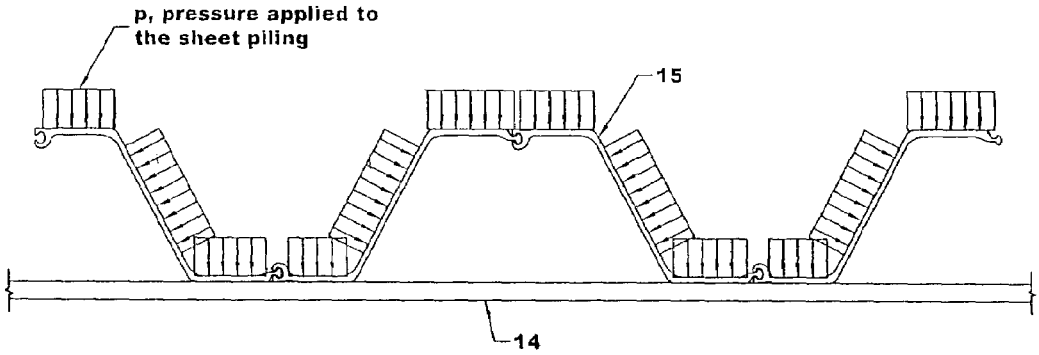
FIG. 4 is a plan view of the sheet piling with load applied for finite testing and analysis.
Figure 5:
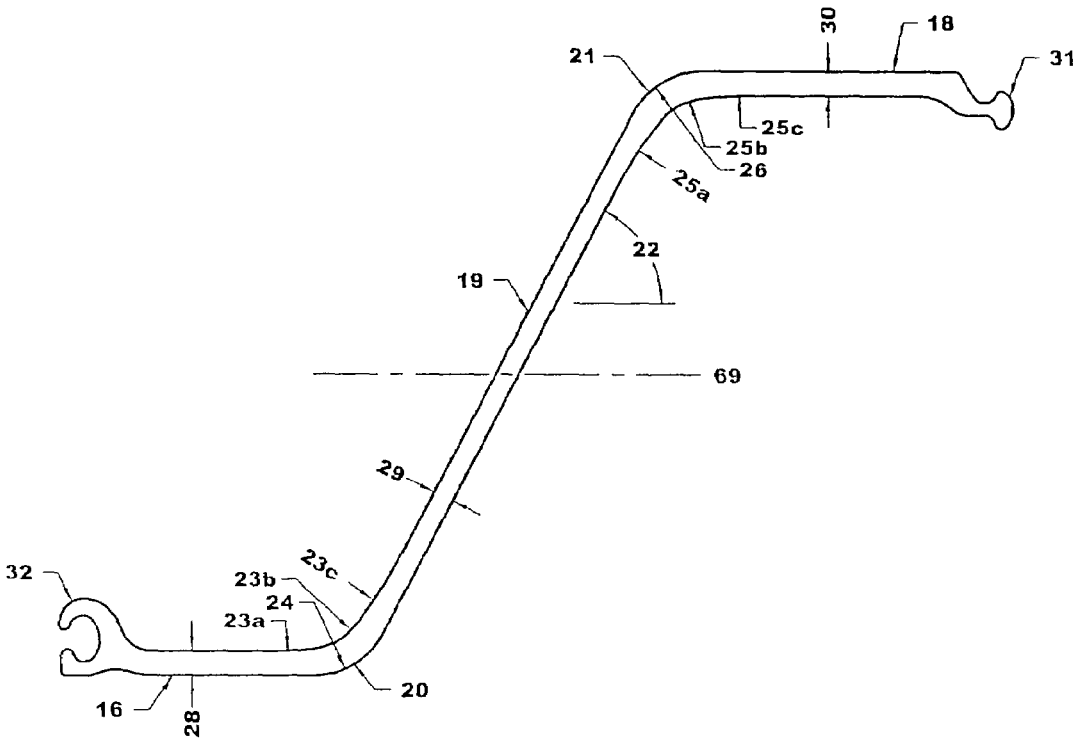
FIG. 5 is a transverse horizontal sectional view of a sheet piling shown in FIG. 1.

Referring now to the drawings, and, more particularly, to FIG. 1 thereof, this invention provides an improved Z-shaped sheet piling, of which the presently preferred embodiment is generally indicated at 15. As shown in FIG. 5, the improved sheet piling 15 broadly includes a first flange 16, a web 19, and a second flange 18. The left marginal end of flange 16 is provided with a socket connection 32. The right marginal end of second flange 18 is provided with a ball connection 31. As shown in FIGS. 3–4, ball 31 and socket 32 connections, or other similar interlocks known in the art, allow the joining of individual sections of sheet piling to form a continuous steel wall, which may be employed in the construction of bridge piers, cofferdams, bridge abutments, bulkheads or the like.

Figure 10:
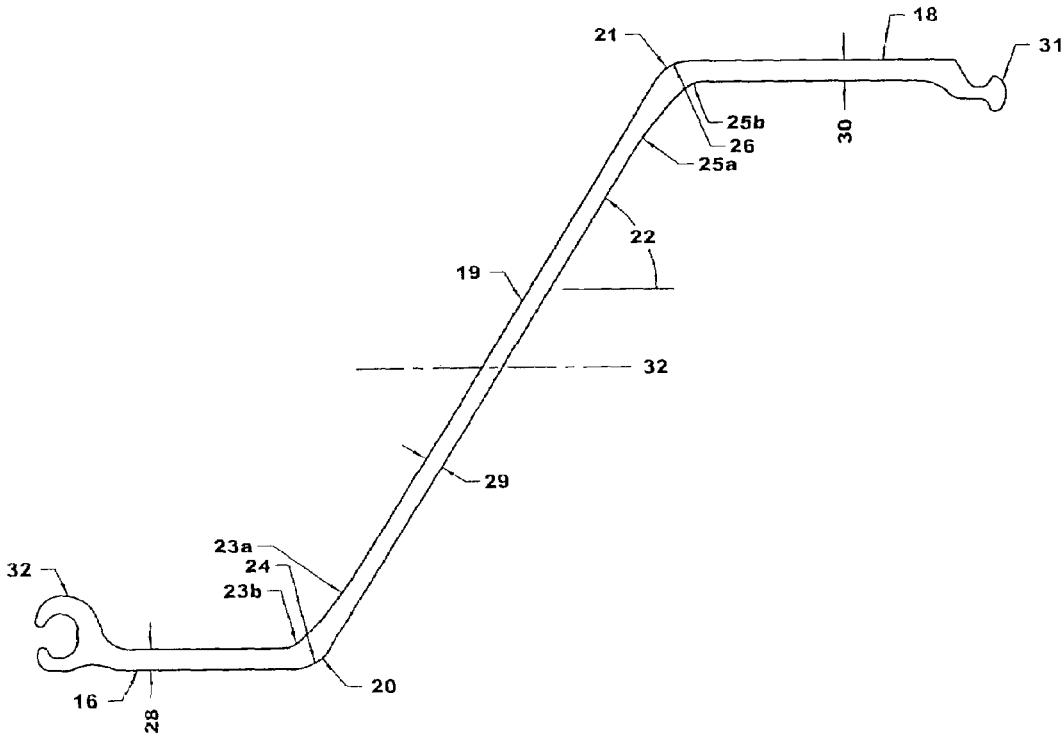
FIG. 10 is a transverse horizontal sectional view of an alternate embodiment of a sheet piling shown in FIG. 1.

As shown in FIGS. 5 and 10, in each of the two general embodiments flange 16 and web 19 are connected at arcuate junction 20. Similarly, web 19 and flange 18 are connected at arcuate junction 21. Flange 16 is a substantially-planar steel member having a thickness dimension 28. Similarly, web 19 and flange 18 are substantially-planar members with thickness dimensions 29 and 30, respectively. Flange 16 and flange 18 are generally parallel to each other. Web 19 transversely connects flanges 16 and 18. However, rather than a perpendicular connection between flanges 16 and 18, web 19 intersects flange 16 at a web angle 22.

Figure 6A:
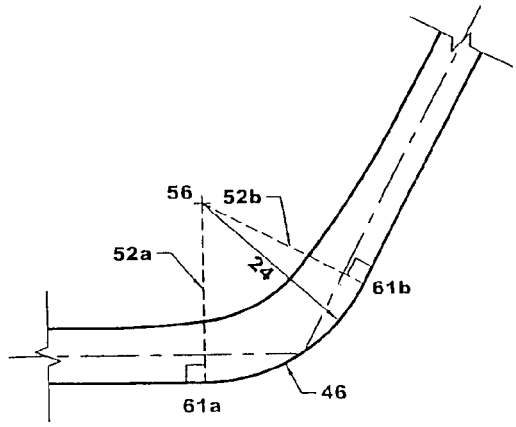
FIG. 6A is a second detailed view of the first junction shown in FIG. 5.
Figure 6:
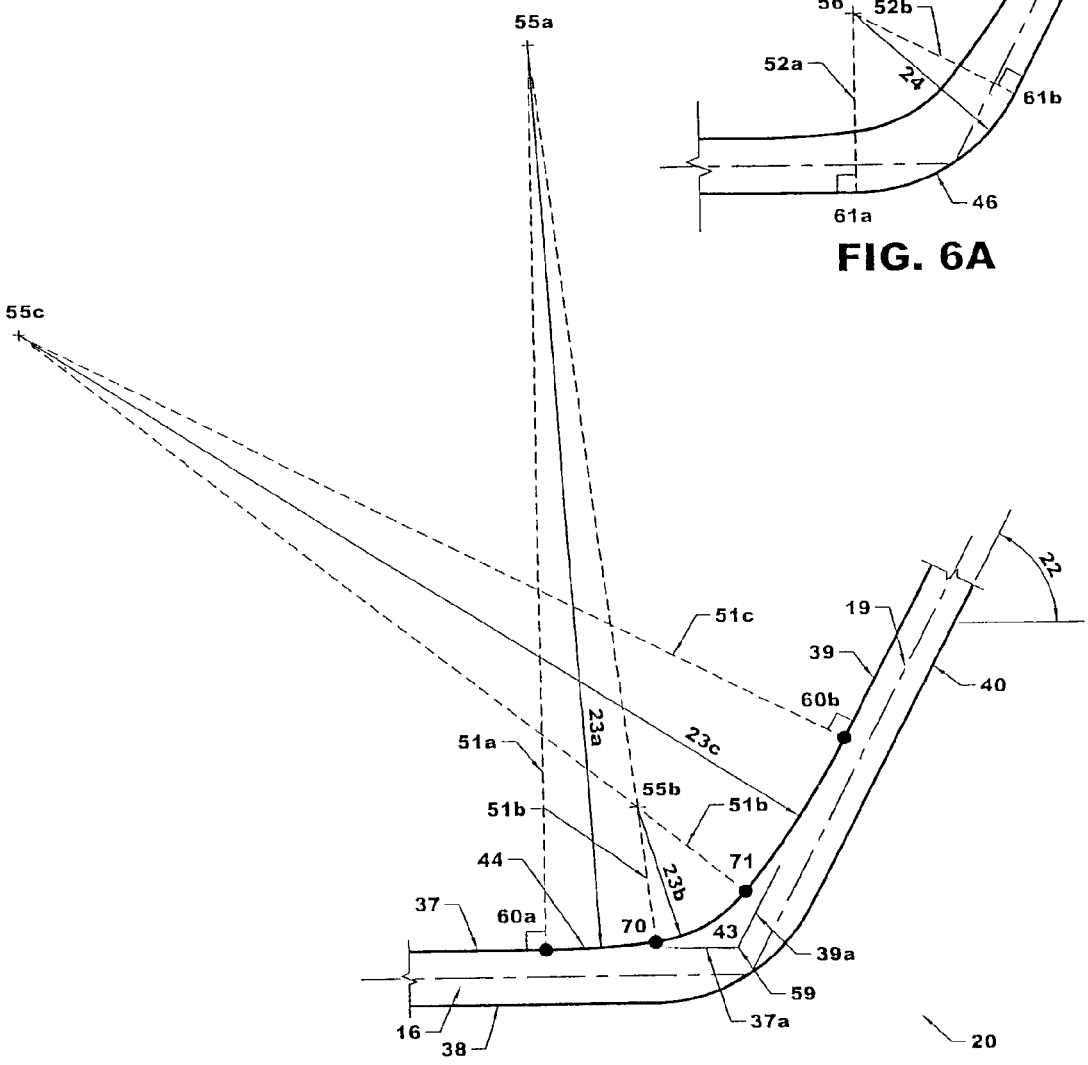
FIG. 6 is a detailed view of the first junction shown in FIG. 5.
Figures 7, 7A:
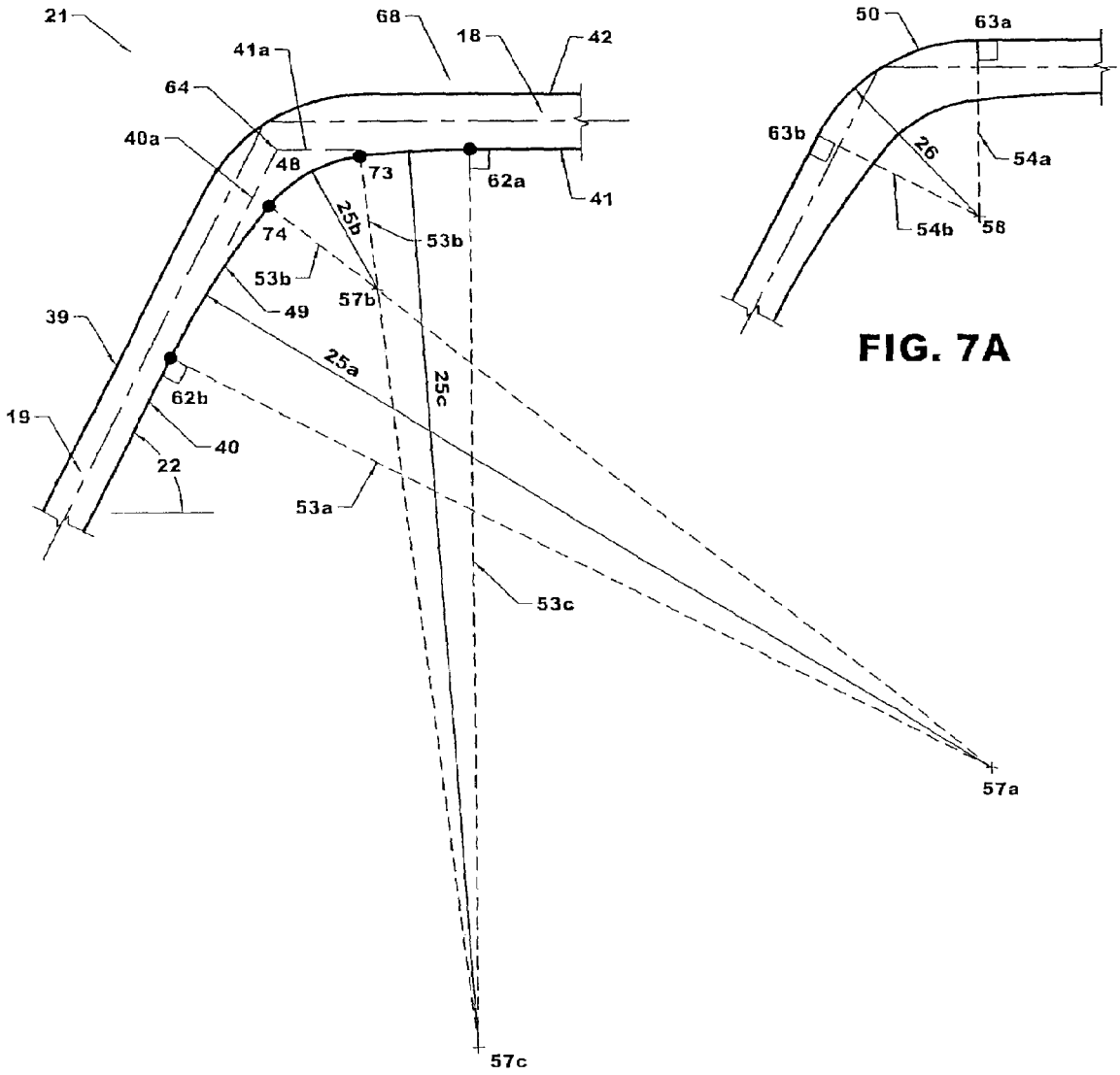
FIG. 7 is a detailed view of the second junction shown in FIG. 5.
FIG. 7A is a second detailed view of the second junction shown in FIG. 5.
Figure 11A:
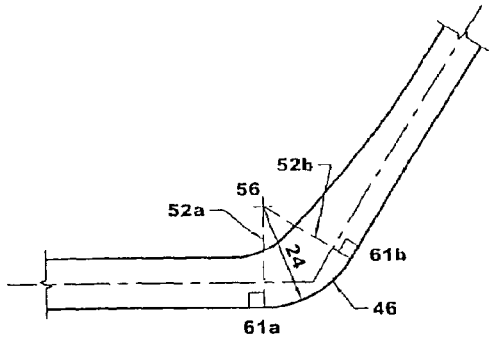
FIG. 11A is a second detailed view of the first junction shown in FIG. 10.
Figure 11:
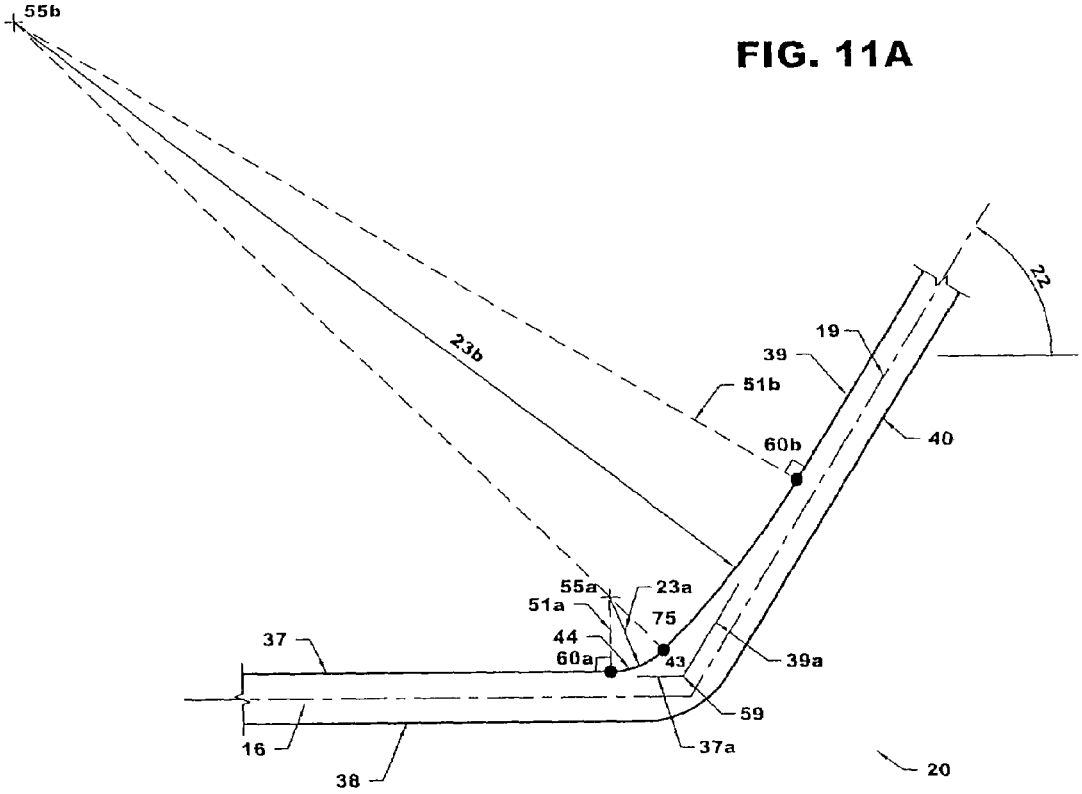
FIG. 11 is a detailed view of the first junction shown in FIG. 10.
Figure 12A:
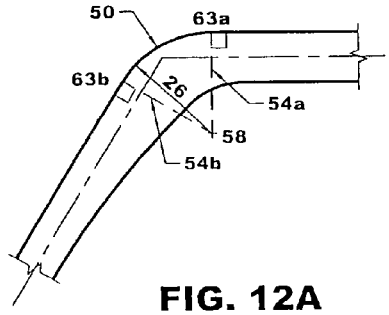
FIG. 12A is a second view of the second junction shown in FIG. 10.
Figure 12:
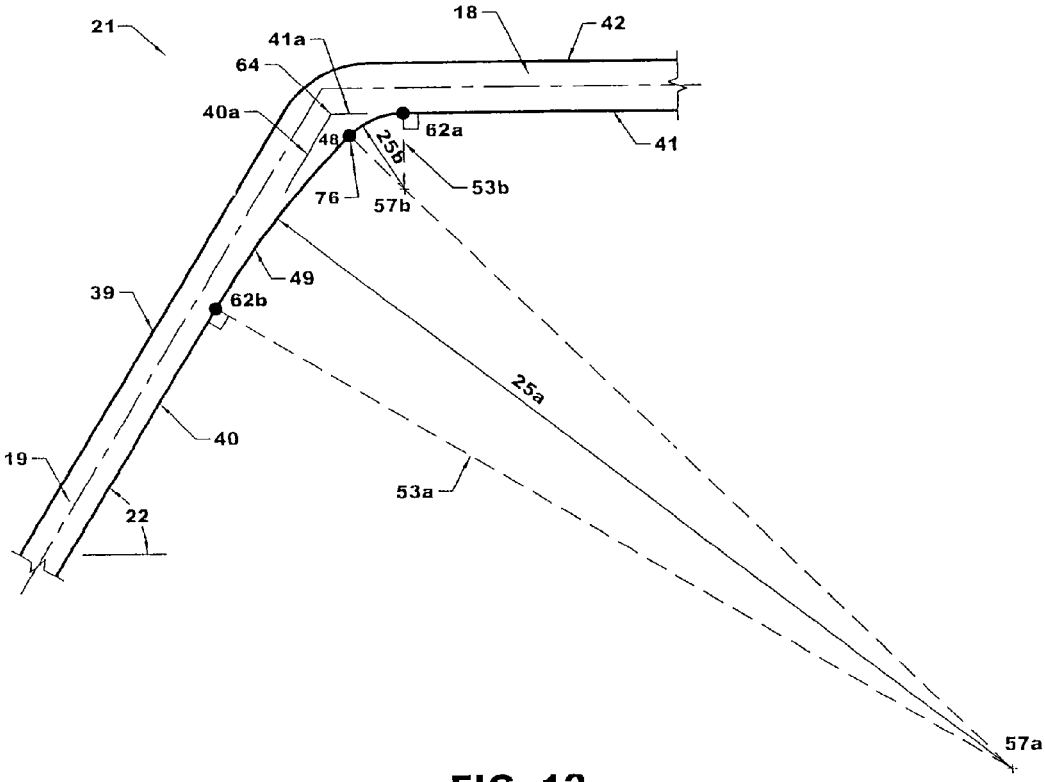
FIG. 12 is a second detailed view of the second junction shown in FIG. 10.

As shown in FIGS. 6 and 11, in each of the two general embodiments junction 20 is generally defined by web angle 22, inner surface 44 and outer arcuate surface 46. In each embodiment,junction 20 is the substantially arcuate portion connecting web 19 and flange 16. As shown in FIGS. 7 and 12, in each of the two general embodiments junction 21 is generally defined by web angle 22, inner surface 49 and outer arcuate surface 50. Junction 20 has an inner surface 44 and an outer arcuate surface 46. In each embodiment, junction 21 is the substantially arcuate portion connecting web 19 and flange 18. Junction 21 has an inner surface 49 and an outer arcuate surface 50. Flange 18 has substantially parallel inner and outer surfaces 41 and 42. Flange 16 has substantially parallel inner and outer surfaces 37 and 38. Similarly, web 19 has substantially parallel inner and outer surfaces 39 and 40.

Figure 8:
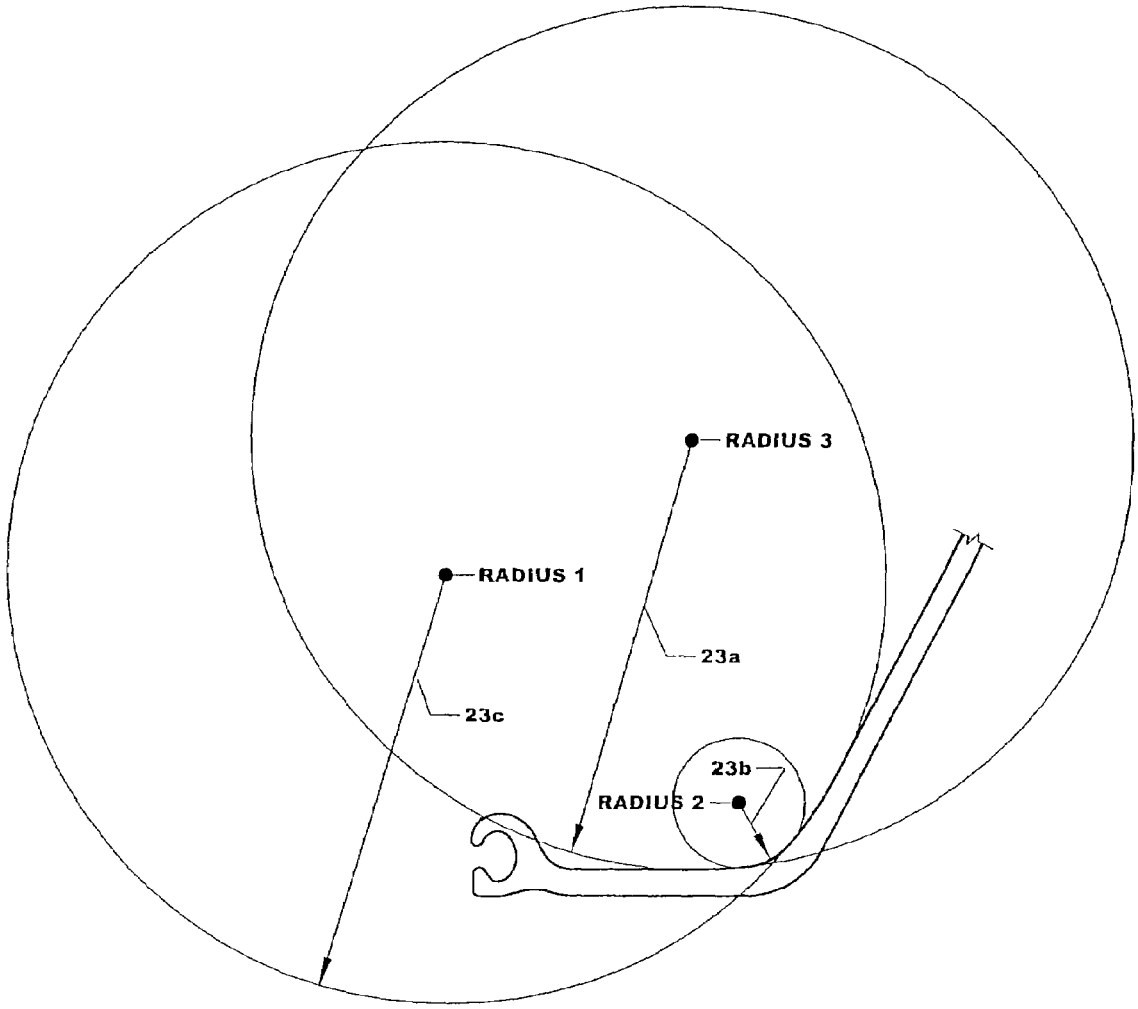
FIG. 8 is a schematic of the three radii defining the inner surface of the junction shown in FIG. 6.

FIGS. 5–9 show a first general embodiment characterized by junctions 20 and 21 having three inner radii. In this first general embodiment, as shown in FIGS. 6 and 8, surface 44 is generated about three center points, indicated at 55*a*, 55*b* and 55*c*. Surface 44 is thus defined by three inner radii, indicated at 23*a*, 23*b* and 23*c*. Surface 44 thus comprises a first arc distance from 60*a* to 70 of a cylinder having a radius 23*a*, a second arc distance from 70 to 71 of a cylinder having a radius 23*b*, and a third arc distance from 71 to 60*b* of a cylinder having a radius 23*c*.

Point 55*a* is located at the intersection of imaginary line 51*a* and radius 23*a*. Line 51 a extends perpendicular to flange surface 37 at tangent point 60*a*. Point 55*c* is located at the intersection of imaginary line 51*c* and radius 23*c*. Line 51*c* extends perpendicular to inner web surface 39 at tangent point 60*b*. Tangent point 60*a* is located at the intersection of surface 37 and arcuate surface 44, which is the point at which the inner surface 37 of flange 16 begins to bend towards inner web surface 39. Similarly, tangent point 60*b* is located at the intersection of surface 44 and surface 39. Point 55*b* is located at the intersection of imaginary line 51*b* and radius 23*b*. Line 51*b* extends perpendicularly from tangent point 70, the point at which the curvature of surface 44 changes from being defined by radius 23*a* to being defined by radius 23*b*. It also can extend from tangent point 71, the point at which the curvature of surface 44 changes from being defined by radius 23*b* to being defined by radius 23*c*.

As shown in FIG. 6, the plane of inner flange surface 37 and of inner web surface 39, respectively, may be extended into junction 20 to imaginary intersection point 59. Arcuate surface 44, which is in turn defined by radii 23*a*–*c*, the extension 39*a* of inner web surface 39, and the extension 37*a* of inner flange surface 37, define fillet 43.

As shown in FIG. 6A, outer junction surface 46 is generated about center point 56 and has a radius 24. Surface 46 is defined by a single arc distance of a cylinder having a radius 24. Flange 16 has an outer surface 38 and web 19 has an outer surface 40. Outer surface 38 and outer surface 40 are joined by arcuate outer surface 46. Center point 56 is located at the intersection of imaginary lines 52*a* and 52*b*. Line 52*a* extends perpendicular to flange outer surface 38 at tangent point 61*a* and line 52*b* extends perpendicular to outer web surface 40 at tangent point 61*b*. Tangent points 61*a* and 61*b* are located at the intersections of surface 46 and surfaces 38 and 40, respectively.

Figure 9:
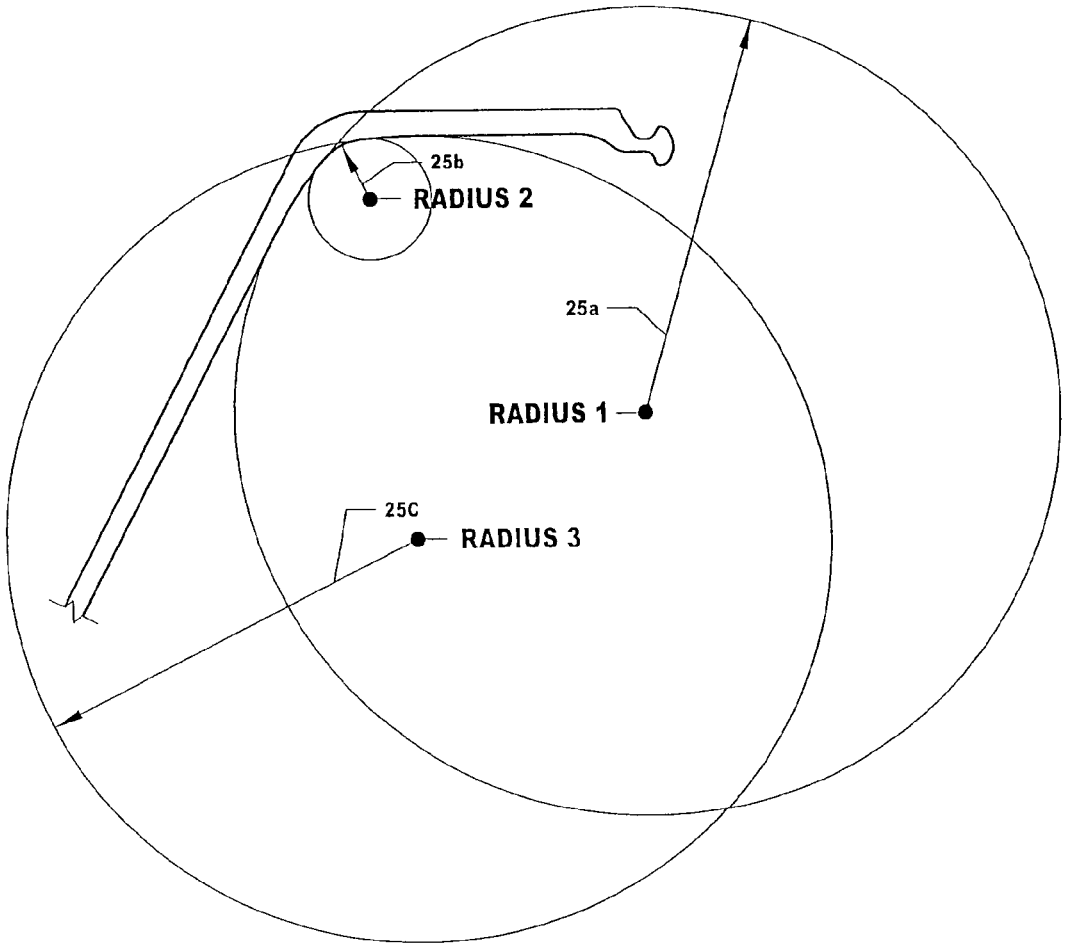
FIG. 9 is a schematic of the three radii defining the inner surface of the junction shown in FIG. 7.

In this first general embodiment, as shown in FIGS. 7 and 9, surface 49 is generated about three center points, indicated at 57*a*, 57*b* and 57*c*. Surface 49 is thus defined by three inner radii, indicated at 25*a*, 25*b* and 25*c*. Surface 49 thus comprises a first arc distance from 62*b* to 74 of a cylinder having a radius 25*a*, a second arc distance from 74 to 73 of a cylinder having a radius 25*b*, and a third arc distance from 73 to 62*a* of a cylinder having a radius 25*c*.

Point 57*a* is located at the intersection of imaginary line 53*a* and radius 25*a*. Line 53*a* extends perpendicular to web surface 40 at tangent point 62*b*. Point 57*c* is located at the intersection of imaginary line 53*c* and radius 25*c*. Line 53*c* extends perpendicular to flange surface 41 at tangent point 62*a*. Tangent point 62*a* is located at the intersection of surface 41 and arcuate surface 49, which is the point at which the inner surface 41 of flange 18 begins to bend towards web surface 40. Similarly, tangent point 62*b* is located at the intersection of surface 40 and surface 49. Point 57*b* is located at the intersection of imaginary line 53*b* and radius 25*b*. Line 53*b* extends perpendicularly from tangent point 74, the point at which the curvature of surface 40 changes from being defined by radius 25*a* to being defined by radius 25*b*. It also can extend from tangent point 73, the point at which the curvature of surface 49 changes from being defined by radius 25*b* to being defined by radius 25*c*.

As shown in FIG. 7, the plane of inner flange surface 41 and of web surface 40, respectively, may be extended into junction 21 to imaginary intersection point 64. Arcuate surface 49, which is in turn defined by radii 25*a–c*, the extension 40*a* of web surface 40, and the extension 41*a* of inner flange surface 41, define fillet 48.

As shown in FIG. 7A, outer junction surface 50 is generated about center point 58 and has a radius 26. Surface 50 is defined by a single arc distance of a cylinder having a radius 26. As mentioned above, flange 18 has an outer surface 42 and web 19 has a surface 39. Surface 42 and surface 39 are joined by arcuate outer surface 50. Center point 58 is located at the intersection of imaginary lines 54*a* and 54*b*. Line 54*a* extends perpendicular to flange outer surface 42 at tangent point 63*a* and line 54*b* extends perpendicular to web surface 39 at tangent point 63*b*. Tangent points 63*a* and 63*b* are located at the intersections of surface 50 and surfaces 42 and 39, respectively.

Sheet pilings may be analyzed to calculate transverse (perpendicular to the interlock) stresses and the calculation for the allowable longitudinal moment ("ML") of the pilings has been expanded to include the effect of transverse stresses:

$$M_L = \frac{I}{y}\left(\frac{Fy}{FS} - (Ts)(p)\right)$$

where "Ts" is the transverse stress contribution, "I" is the moment of inertia of the cross section, "y" is the distance from the centroidal axis to the point of calculating the stresses, "Fy" is the yield stress. "FS" is the factor of safety, and "p" is the normal pressure. The "transverse stress contribution" is a value calculated mathematically. The formulation of allowable longitudinal bending moment in the piling is based on use of the Maximum Shear Stress Failure Criterion.

Figure 2:
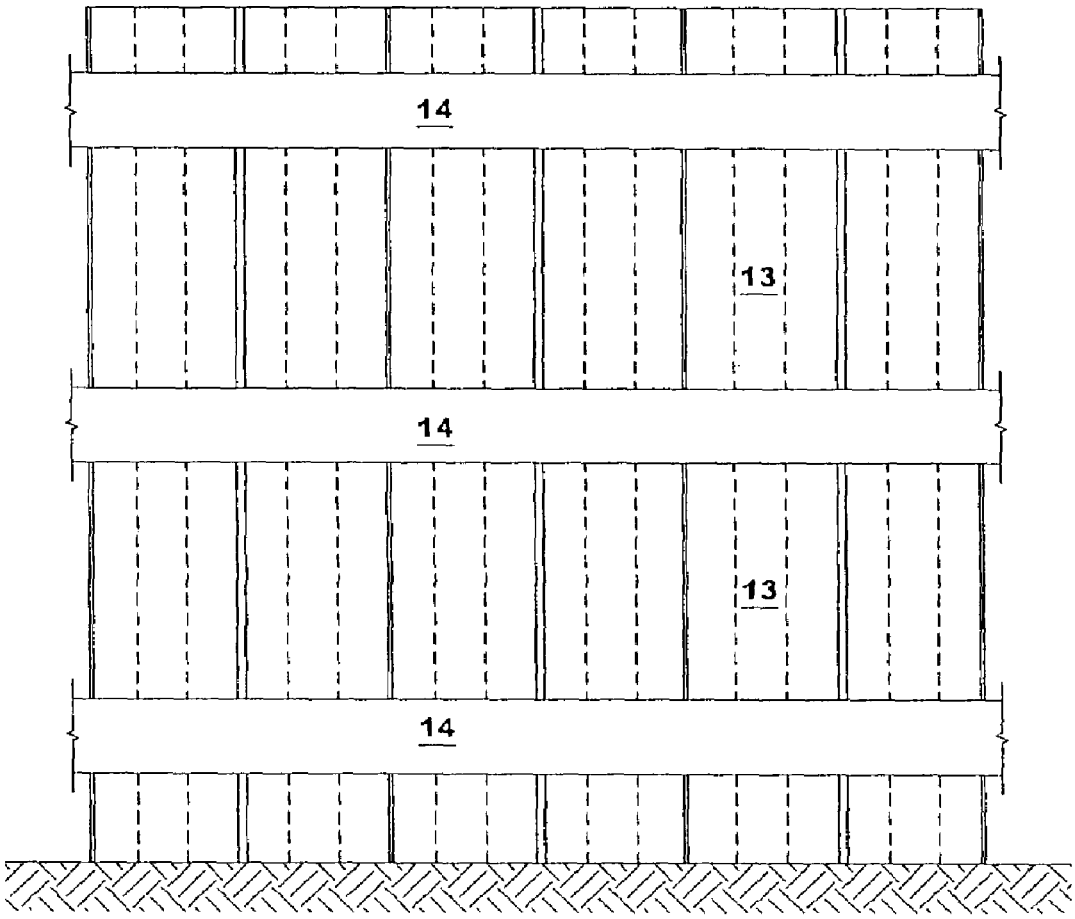
FIG. 2 is a left side elevation of the sheet piling shown in FIG. 1.

FIG. 4 shows the improved sheet piling for both general embodiments under loading conditions of one psi oriented normal to the longitudinal surface of the piling. This is the applied pressure load. FIGS. 1–2 show and generally differentiate between wale positions 12 and span positions 13. Wale positions 12 are at those longitudinal points on the piling at which the piling is constrained by a wale 14, and span positions 13 are at those longitudinal points at which the piling is not constrained by a wale 14. The wale location is meant to be that location in the piling which controls the allowable moment of the piling at wale position 12. The span location is meant to be that location in the piling which controls the allowable moment of the piling at span positions 13.

Six different specific embodiments of the invention are provided, which are delineated by weight per square foot of wall. The embodiments are hereafter identified as PZ35, PZ40, PZC21.7, PZC24.2, PZC31.8 and PZC39.7. Using linear finite element analysis, Applicant tested each of these embodiments, the results of which are provided in FIGS. 15–26, with the allowable longitudinal moment on the y axis and pressure on the x axis. The design curve plots the allowable longitudinal moment as a function of pressure for a standard steel yield strength of 50 ksi (kilopounds per square inch) and a factor of safety FS of 1.538 (allowable stress being 65 percent (65%) of the steel yield stress). The pressure is applied normal to the surfaces of the piling. Accordingly, Applicant has discovered that it is highly beneficial to form the pilings with at least two radii, rather than just one. Such a new design allows for more selective reduction of the transverse stresses flowing through the cross-section of the piling. The sets of two graphical depictions shown in FIGS. 15–26 illustrate the allowable moment as a function of pressure for the improved piling at the span and wale locations, respectively, for the six specific sheet pilings.

Of the six specific embodiments, the PZ35, PZ40, PZC21.7 and PZC24.2 employ junctions defined by an inner surface having three inner radii as generally shown in FIGS. 5–9. As shown, the arcs from 60*a* to 70 and from 71 to 60*b* in this general embodiment have substantially less curvature than the arc from 70 to 71. As a result, steel is extended further along surface 37 of flange 16 and surface 39 of web 19, respectively, and steel is concentrated less at the central portion of junction 20. The greater the radius, the flatter the arc and the thinner and further along the subject surface the steel extends. It is contemplated that surface 44 could consist of one or more linear rather than arcuate sections, with the subject radius thereby approaching infinite.

The structural dimensions and the data from the finite analysis, as more fully shown in FIGS. 15–22, of these four specific embodiments are summarized in following charts A1–A4 and B1–B4, respectively.

CHART A1

| PZ35- Physical Characteristics | | |
|---|---|---|
| Weight | 35.0 | psf |
| Moment of Inertia | 369.5 | $in^4/ft$ |
| Section Modulus | 48.9 | $in^3/ft$ |
| Web Angle | 62.7 | degrees |
| First Junction Inner Radii | | |
| a. radius 1 (web) | 10 | in |
| b. radius 2 (central) | 1.5 | in |
| c. radius 3 (flange) | 10 | in |
| First Junction Outer Radius | 1.957 | in |
| Second Junction Inner Radii | | |
| a. radius 1 (web) | 10 | in |
| b. radius 2 (central) | 1.5 | in |
| c. radius 3 (flange) | 10 | in |
| Second Junction Outer Radius | 1.957 | in |
| First Flange Thickness | 0.605 | in |
| Second Flange Thickness | 0.605 | in |
| Web Thickness | 0.5 | in |
| Cross-Sectional Area | 19.4 | $in^2$ |
| Distance from Centroid to the First Flange Outer Surface | 7.55 | in |
| Distance Between the First Flange Outer Surface and the Second Flange Outer Surface | 15.1 | in |

CHART B1

| PZ35- Strength | |
|---|---|
| Transverse Stress at Wale Location between 0 and 6.59 psi | 131.8 psi per psi applied pressure |
| Transverse Stress at Span Location between 0 and 36.92 psi | 343.7 psi per psi applied pressure |
| Total Area Under Curve at Wale Location | 41,650 |
| Area Under Curve between 0 psi and 20 psi at Wale Location | 29,050 |
| Total Area Under Curve at Span Location | 69,650 |
| Area Under Curve between 0 psi and 20 psi at Span Location | 28,450 |

CHART A2

| PZ40- Physical Characteristics | |
|---|---|
| Weight | 40.1 psf |
| Moment of Inertia | 504.2 $in^4/ft$ |
| Section Modulus | 61.5 $in^3/ft$ |
| Web Angle | 74.1 degrees |
| First Junction Inner Radii | |
| a. radius 1 (web) | 10 in |
| b. radius 2 (central) | 0.875 in |
| c. radius 3 (flange) | 10 in |
| First Junction Outer Radius | 1.5 in |
| Second Junction Inner Radii | |
| a. radius 1 (web) | 10 in |
| b. radius 2 (central) | 0.875 in |
| c. radius 3 (flange) | 10 in |
| Second Junction Outer Radius | 1.5 in |
| First Flange Thickness | 0.605 in |
| Second Flange Thickness | 0.605 in |
| Web Thickness | 0.5 in |
| Cross-Sectional Area | 19.3 $in^2$ |
| Distance from Centroid to the First Flange Outer Surface | 8.2 in |
| Distance Between the First Flange Outer Surface and the Second Flange Outer Surface | 16.4 in |

CHART B2

| PZ40- Strength | |
|---|---|
| Transverse Stress at Wale Location between 6.37 and 39.21 psi | 423.1 psi per psi applied pressure |
| Transverse Stress at Span Location between 0 psi and 39.8 psi | 335.2 psi per psi applied pressure |
| Total Area Under Curve at Wale Location | 67,850 |
| Area Under Curve between 0 psi and 20 psi at Wale Location | 37,100 |
| Total Area Under Curve at Span Location | 84,800 |
| Area Under Curve between 0 psi and 20 psi at Span Location | 35,850 |

CHART A3

| PZC21.7- Physical Characteristics | |
|---|---|
| Weight | 21.7 psf |
| Moment of Inertia | 15.2 $in^4/ft$ |
| Section Modulus | 24.2 $in^3/ft$ |
| Web Angle | 41.9 degrees |
| First Junction Inner Radii | |
| a. radius 1 (web) | 18 in |
| b. radius 2 (central) | 1 in |
| c. radius 3 (flange) | 6 in |
| First Junction Outer Radius | 2.2 in |

CHART A3-continued

| PZC21.7- Physical Characteristics | |
|---|---|
| Second Junction Inner Radii | |
| a. radius 1 (web) | 18 in |
| b. radius 2 (central) | 1 in |
| c. radius 3 (flange) | 6 in |
| Second Junction Outer Radius | 1.4 in |
| First Flange Thickness | 0.375 in |
| Second Flange Thickness | 0.375 in |
| Web Thickness | 0.375 in |
| Cross-Sectional Area | 14.8 $in^2$ |
| Distance from Centroid to the First Flange Outer Surface | 6.285 in |
| Distance Between the First Flange Outer Surface and the Second Flange Outer Surface | 12.557 in |

CHART B3

| PZC21.7- Strength | |
|---|---|
| Transverse Stress at Wale Location between 1.23 and 20.20 psi | 1561 psi per psi applied pressure |
| Transverse Stress at Span Location between 1.68 and 22.94 psi | 1017 psi per psi applied pressure |
| Total Area Under Curve at Wale Location | 8,650 |
| Area Under Curve between 0 psi and 20 psi at Wale Location | 8,650 |
| Total Area Under Curve at Span Location | 12,500 |
| Area Under Curve between 0 psi and 20 psi at Span Location | 10,800 |

CHART A4

| PZC24.2- Physical Characteristics | |
|---|---|
| Weight | 24.2 psf |
| Moment of Inertia | 255.5 $in^4/ft$ |
| Section Modulus | 33.5 $in^3/ft$ |
| Web Angle | 54.4 degrees |
| First Junction Inner Radii | |
| a. radius 1 (web) | 18 in |
| b. radius 2 (central) | 1 in |
| c. radius 3 (flange) | 6 in |
| First Junction Outer Radius | 1.75 in |
| Second Junction Inner Radii | |
| a. radius 1 (web) | 18 in |
| b. radius 2 (central) | 1 in |
| c. radius 3 (flange) | 6 in |
| Second Junction Outer Radius | 1.135 in |
| First Flange Thickness | 0.375 in |
| Second Flange Thickness | 0.375 in |
| Web Thickness | 0.375 in |
| Cross-Sectional Area | 14.8 $in^2$ |
| Distance from Centroid to the First Flange Outer Surface | 7.625 in |
| Distance Between the First Flange Outer Surface and the Second Flange Outer Surface | 15.25 in |

CHART B4

| PZC24.2- Strength | |
|---|---|
| Transverse Stress at Wale Location between 1.15 and 23.22 psi | 1400 psi per psi applied pressure |
| Transverse Stress at Span Location between 0 and 8.94 psi | 1006 psi per psi applied pressure |
| Total Area Under Curve at Wale Location | 13,250 |

CHART B4-continued

| PZC24.2- Strength | |
|---|---|
| Area Under Curve between 0 psi and 20 psi at Wale Location | 13,000 |
| Total Area Under Curve at Span Location | 16,950 |
| Area Under Curve between 0 psi and 20 psi at Span Location | 14,900 |

Figure 13:
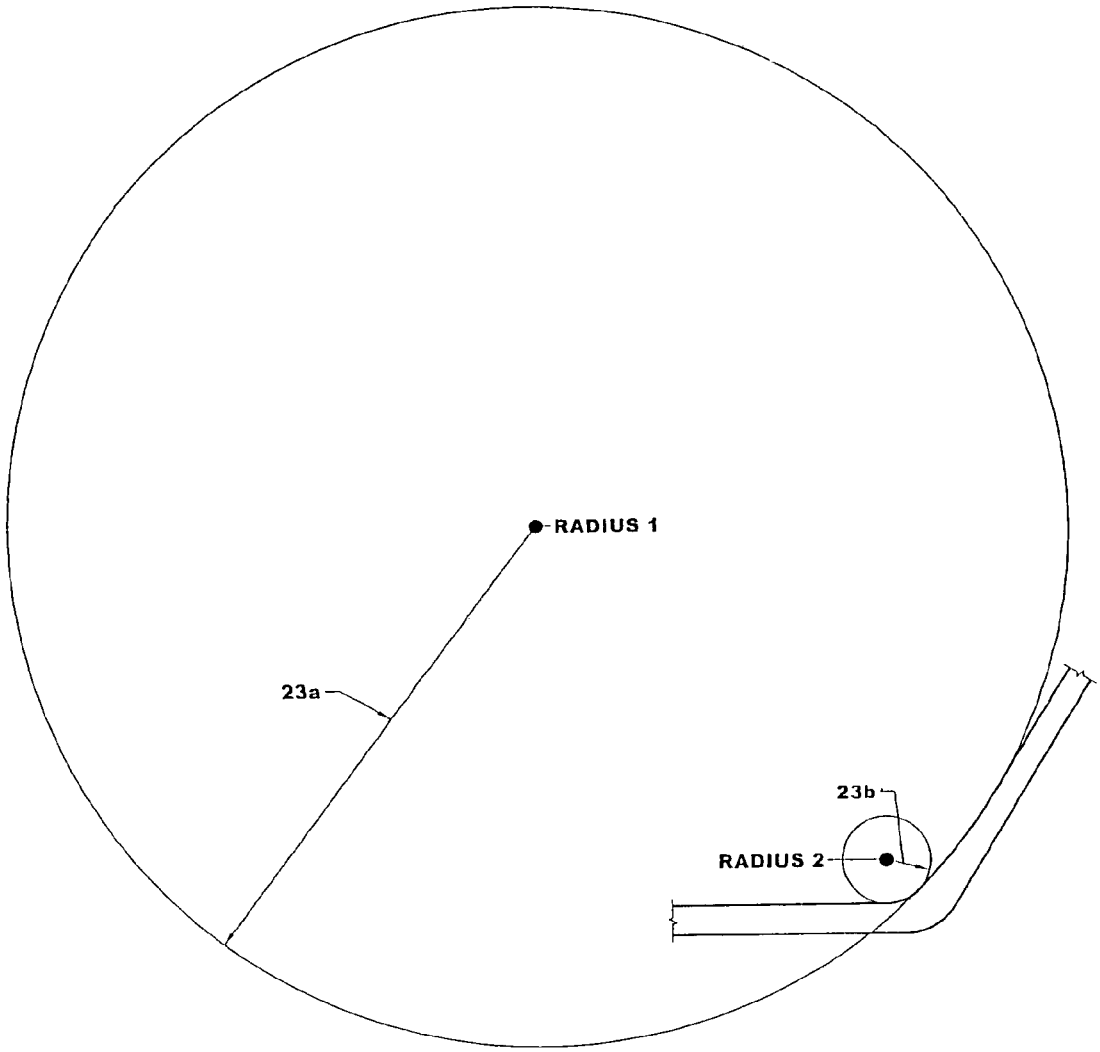
FIG. 13 is a schematic of the two radii defining the inner surface of the junction shown in FIG. 11.

Of the six specific embodiments, PZC31.8 and PZC39.7 employ junctions defined by an arcuate surface having only two radii, as generally shown in FIGS. 10–14. As shown in FIGS. 10–14, the general structure of the Z-shaped piling is similar as the structure of the first general embodiment shown in FIGS. 5–9. However, in this second general embodiment, junctions 20 and 21 and inner surfaces 44 and 49 are defined by two radii rather than three. In particular, in this second general embodiment, as shown in FIGS. 11 and 13, surface 44 is generated about two center points, indicated at 55*a* and 55*b*. Surface 44 is thus defined by two inner radii, indicated at 23*a* and 23*b*. Surface 44 thus comprises a first arc distance from 60*a* to 75 of a cylinder having a radius 23*a* and a second arc distance from 75 to 60*b* of a cylinder having a radius 23*b*.

As shown, the arc from 75 to 60*b* in this embodiment has substantially less curvature than the arc from 60*a* to 75. As a result, steel is extended further along surface 39 of web 19, and steel is extended less along the inner surface 37 of flange 16. The greater the radius, the flatter the arc and the thinner and further along the subject surface the steel extends. It is contemplated that surface 44 could consist of one or more linear rather than arcuate sections, with the subject radius approaching infinite.

In this second general embodiment, point 55*a* is located at the intersection of imaginary line 51*a* and radius 23*a*. Line 51*a* extends perpendicular to flange surface 37 at tangent point 60*a*. It also can extend from tangent point 75, the point at which the curvature of surface 44 changes from being defined by radius 23*a* to being defined by radius 23*b*. Point 55*b* is located at the intersection of imaginary line 51*b* and radius 23*b*. Line 51*b* extends perpendicular to inner web surface 39 at tangent point 60*b*. It too can extend from tangent point 75. Tangent point 60*a* is located at the intersection of surface 37 and arcuate surface 44, which is the point at which the inner surface 37 of flange 16 begins to bend towards inner web surface 39. Similarly, tangent point 60*b* is located at the intersection of surface 44 and surface 39.

As shown in FIG. 11, again the plane of inner flange surface 37 and of inner web surface 39, respectively, may be extended into junction 20 to imaginary intersection point 59. In this general embodiment, arcuate surface 44, which is in turn defined by radii 23*a* and 23*b*, the extension 39*a* of inner web surface 39, and the extension 37*a* of inner flange surface 37, define fillet 43.

Figure 14:
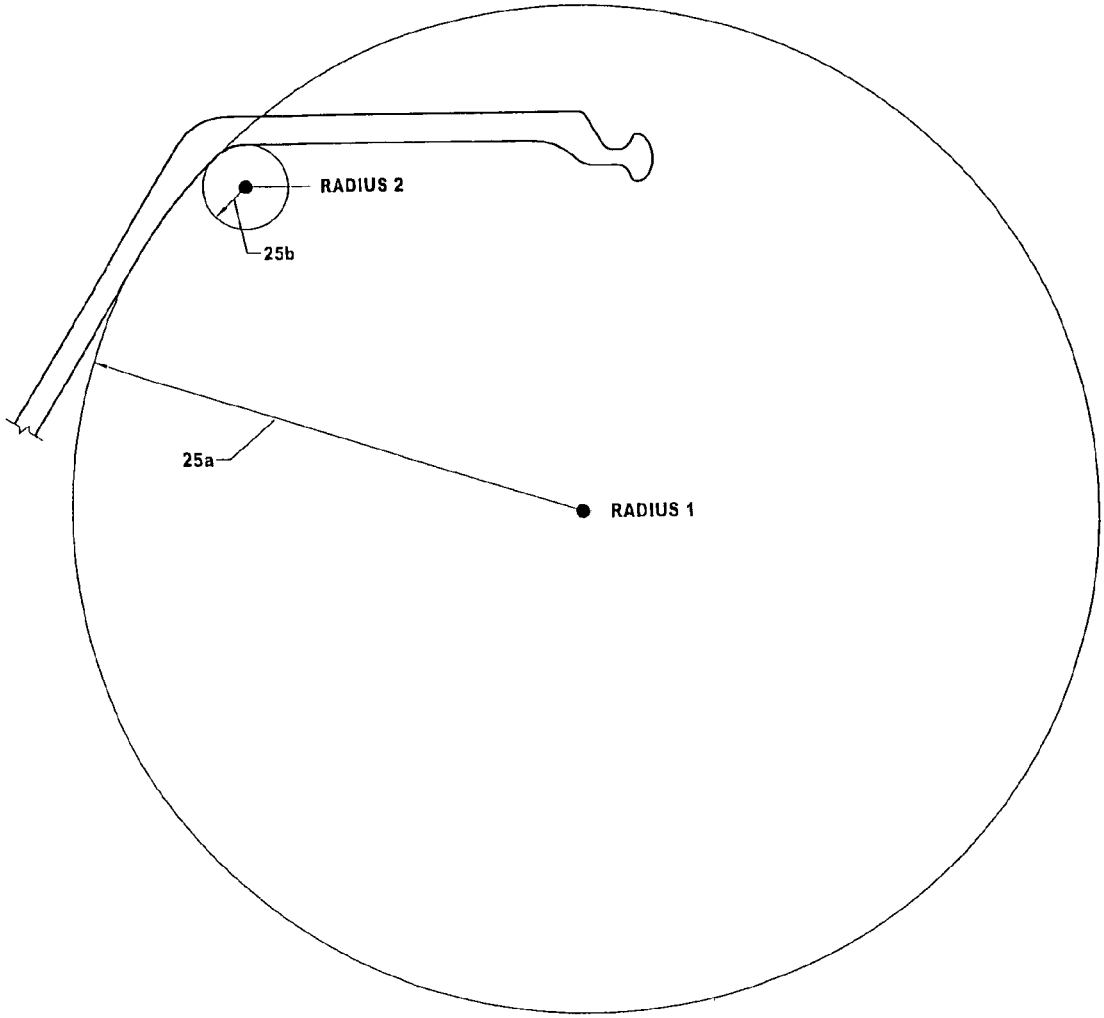
FIG. 14 is a schematic of the two radii defining the inner surface of the junction shown in FIG. 12.
Figure 15:
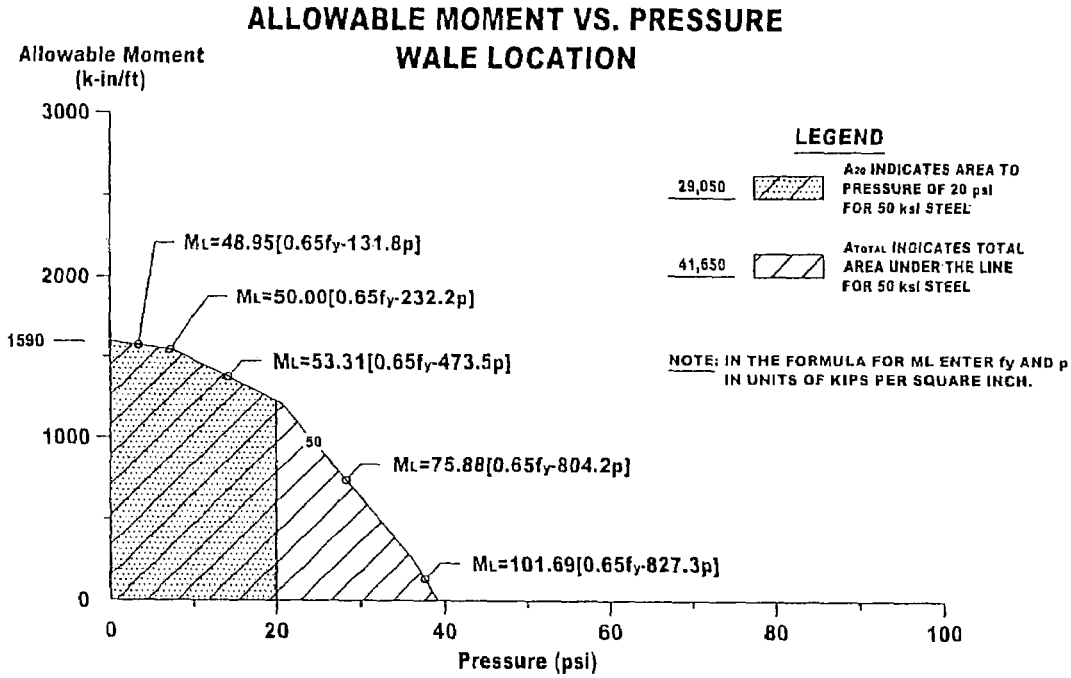
FIG. 15 plots the allowable moment of a first embodiment of the improved piling versus applied pressure at the wale or support location.
Figure 16:
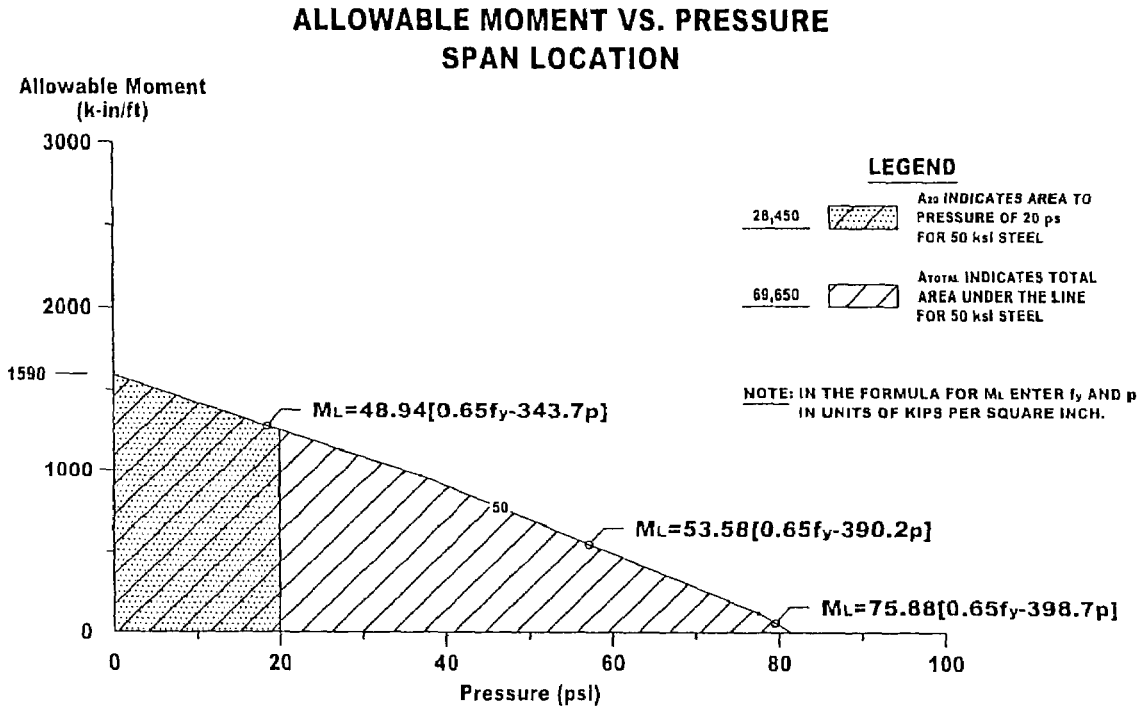
FIG. 16 plots the allowable moment of the first embodiment of the improved piling versus applied pressure at the span location.
Figure 17:
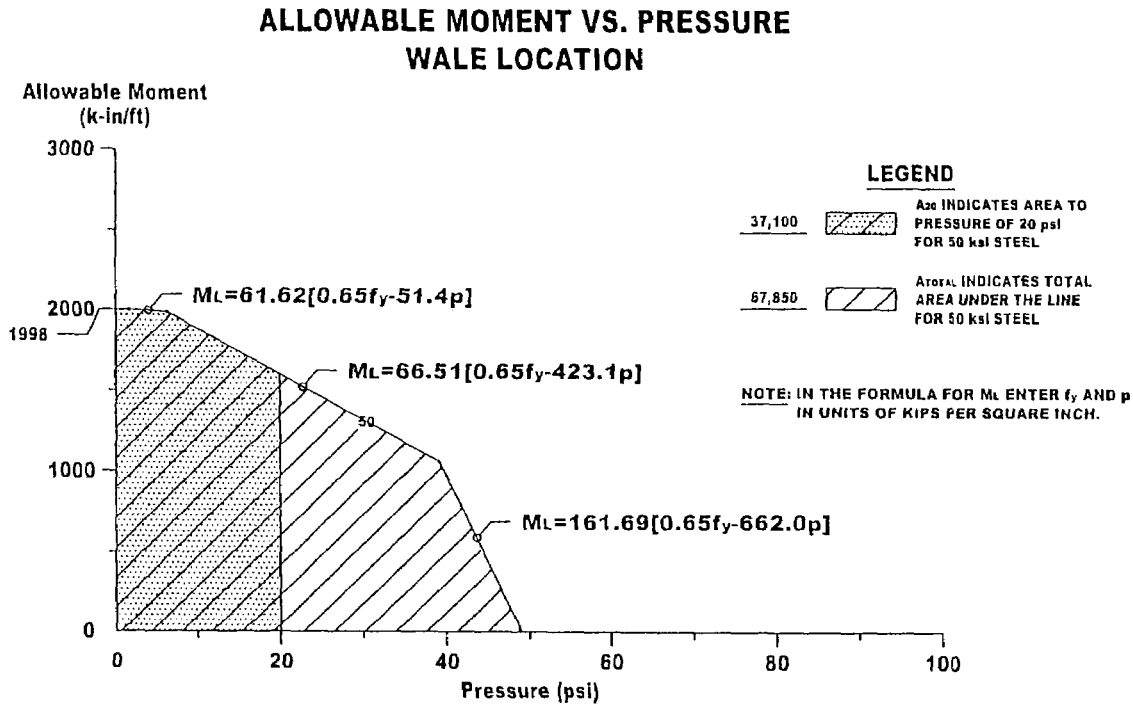
FIG. 17 plots the allowable moment of a second embodiment of the improved piling versus applied pressure at the wale or support location.
Figure 18:
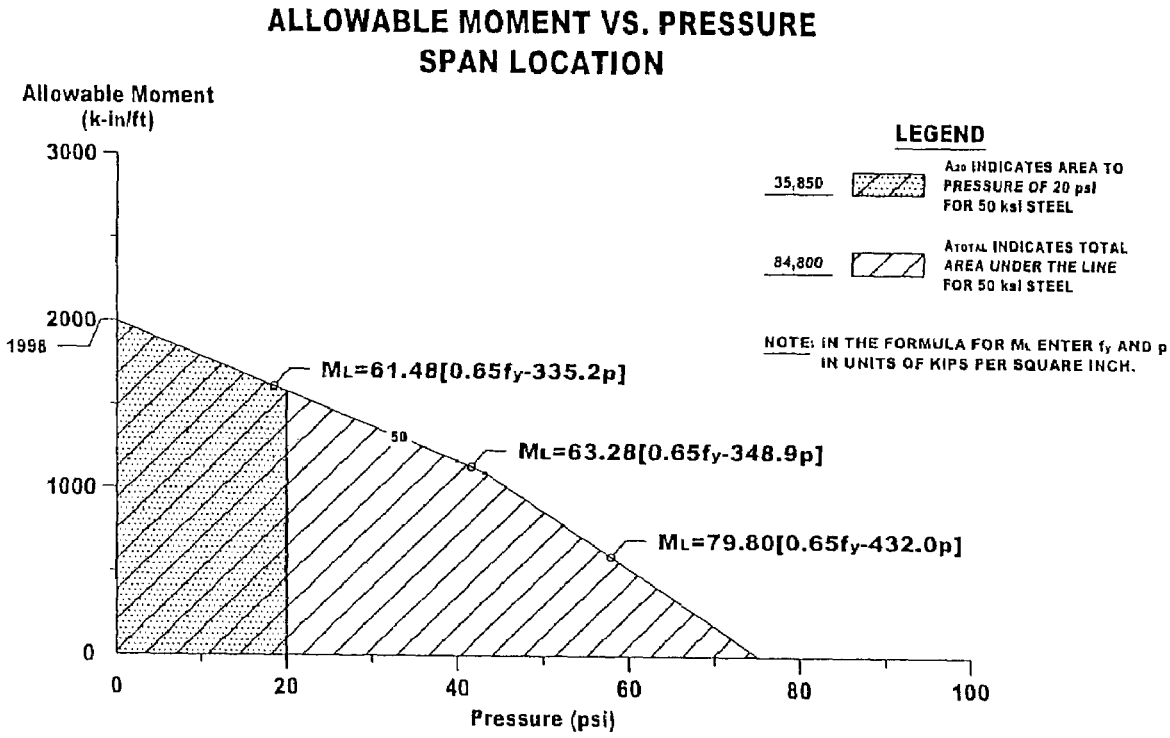
FIG. 18 plots the allowable moment of the second embodiment of the improved piling versus applied pressure at the span location.
Figure 19:
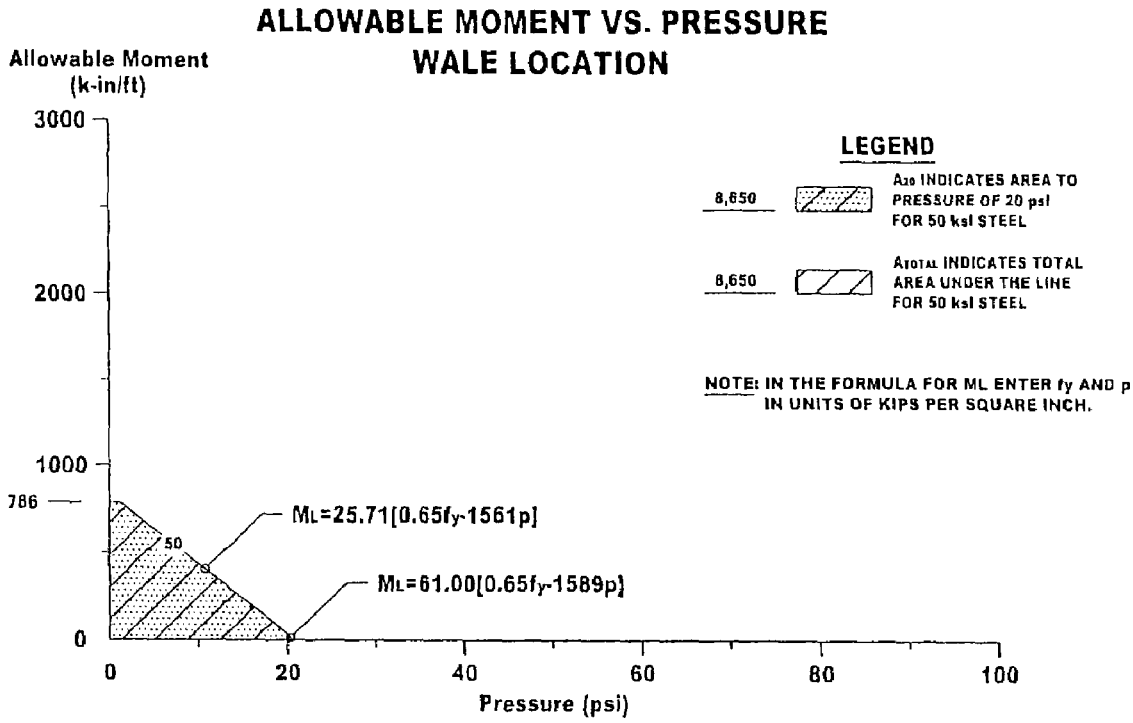
FIG. 19 plots the allowable moment of a third embodiment of the improved piling versus applied pressure at the wale or support location.
Figure 20:
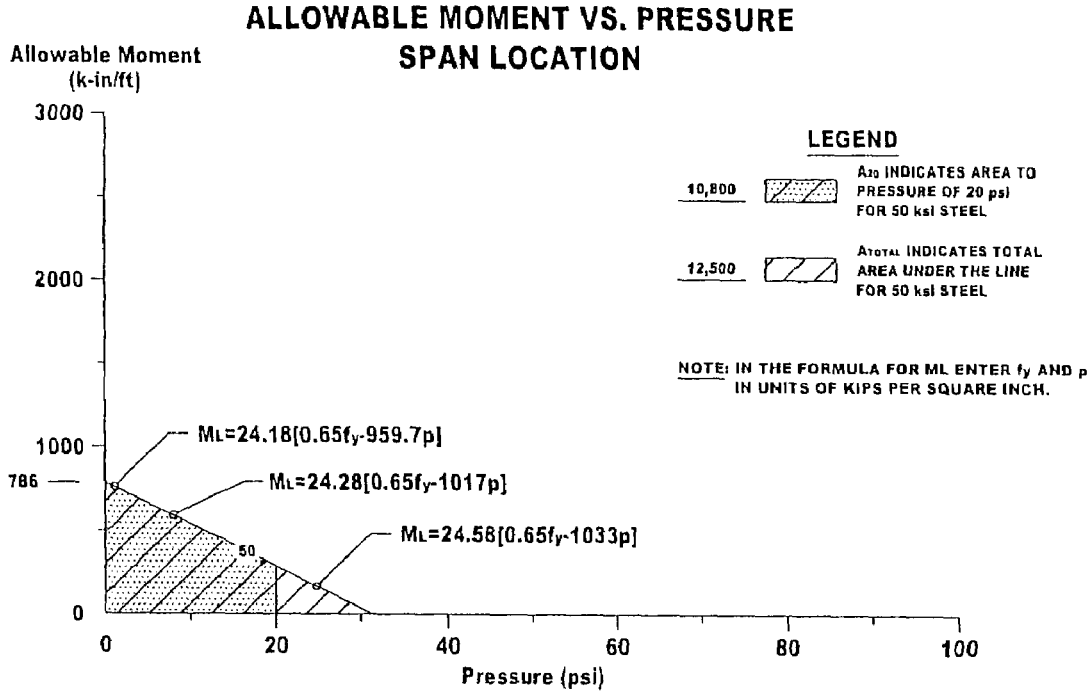
FIG. 20 plots the allowable moment of the third embodiment of the improved piling versus applied pressure at the span location.
Figure 21:
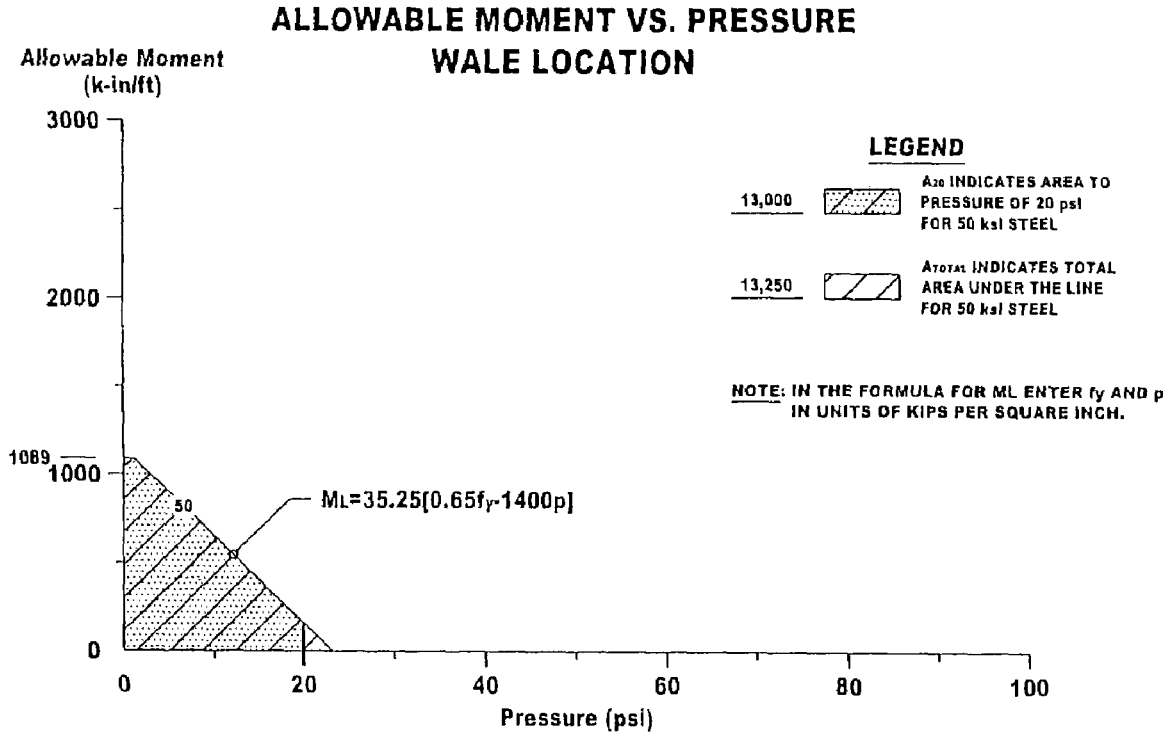
FIG. 21 plots the allowable moment of a fourth embodiment of the improved piling versus applied pressure at the wale or support location.
Figure 22:
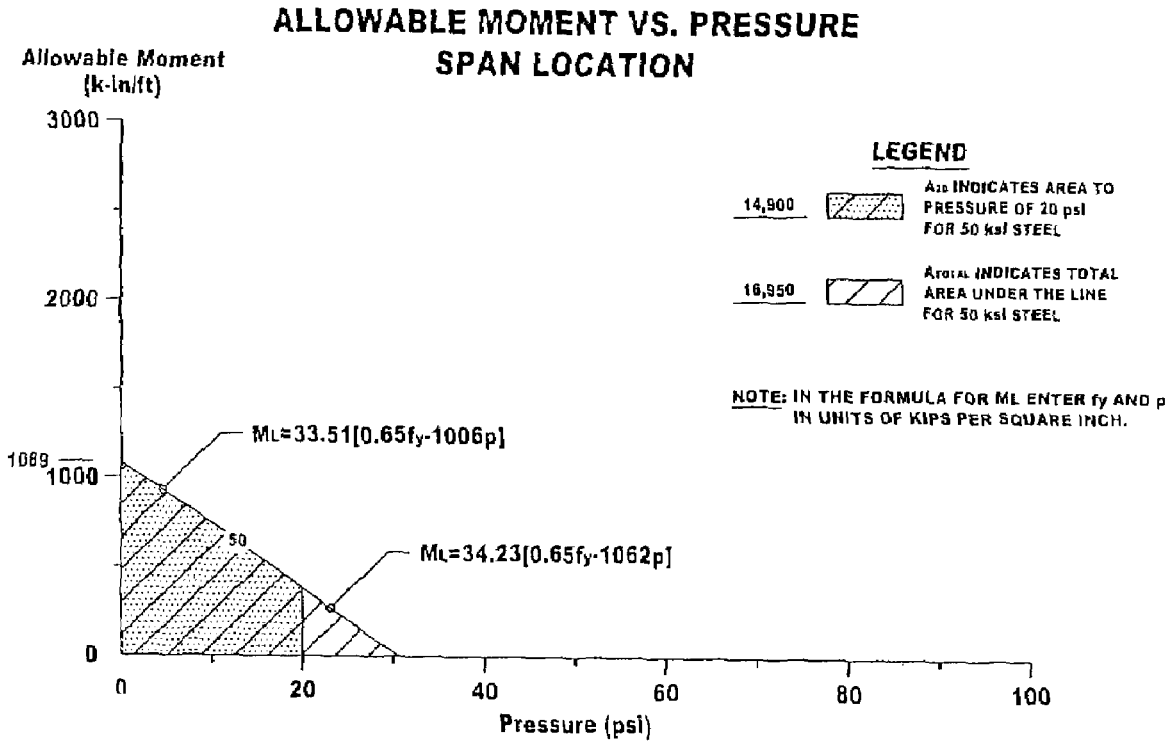
FIG. 22 plots the allowable moment of the fourth embodiment of the improved piling versus applied pressure at the span location.
Figure 23:
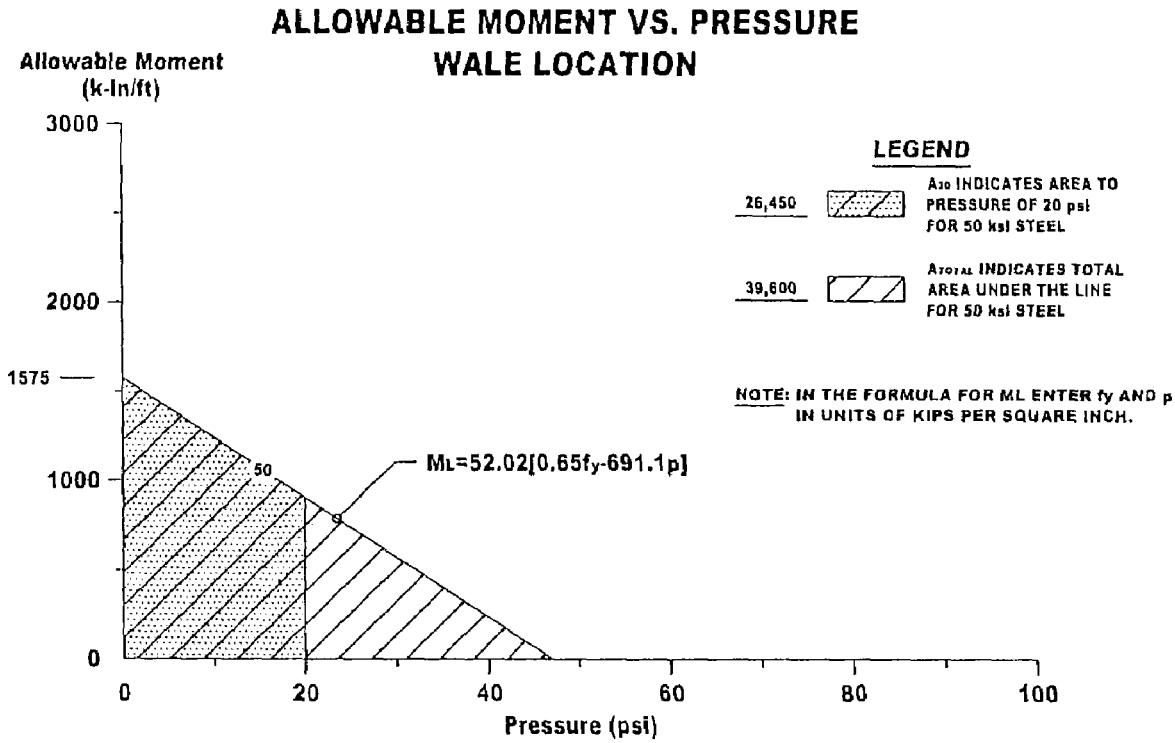
FIG. 23 plots the allowable moment of a fifth embodiment of the improved piling versus applied pressure at the wale or support location.
Figure 24:
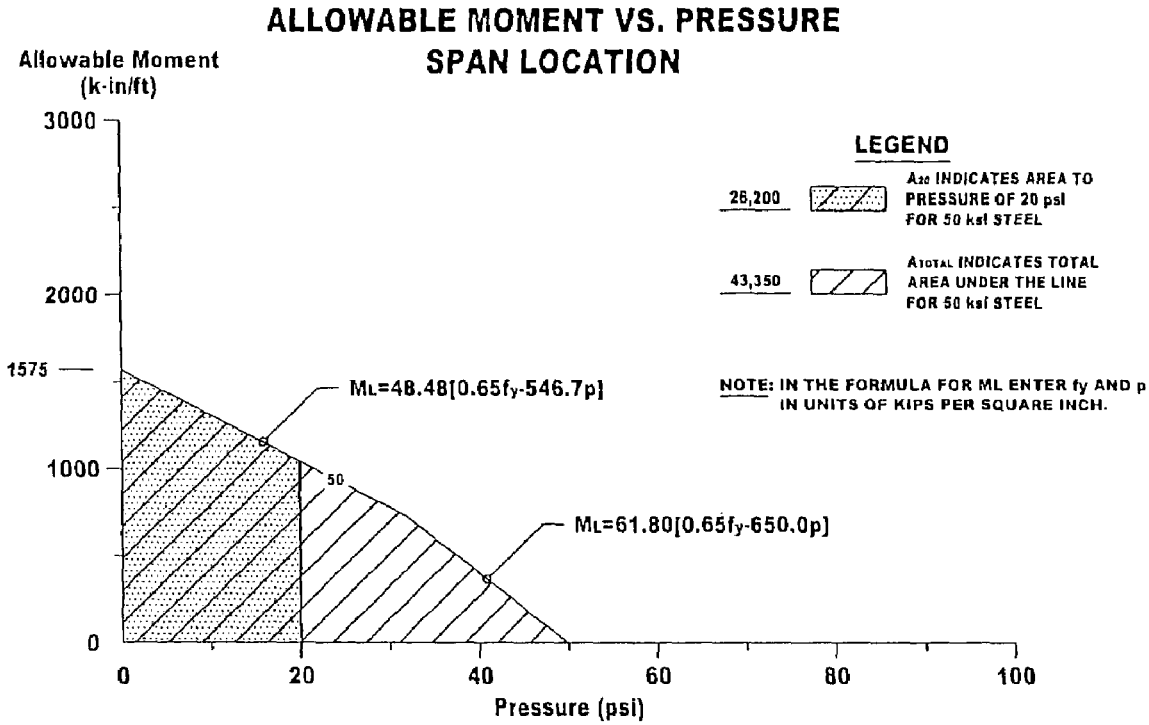
FIG. 24 plots the allowable moment of the fifth embodiment of the improved piling versus applied pressure at the span location.
Figure 25:
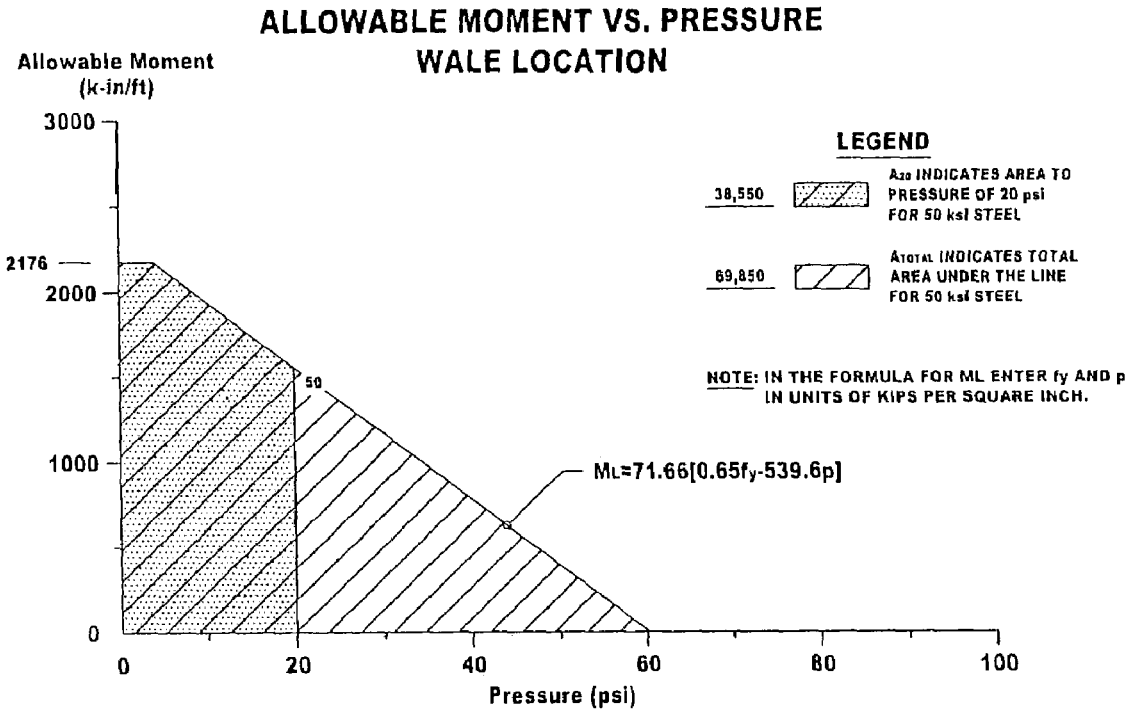
FIG. 25 plots the allowable moment of a sixth embodiment of the improved piling versus applied pressure at the wale or support location.
Figure 26:
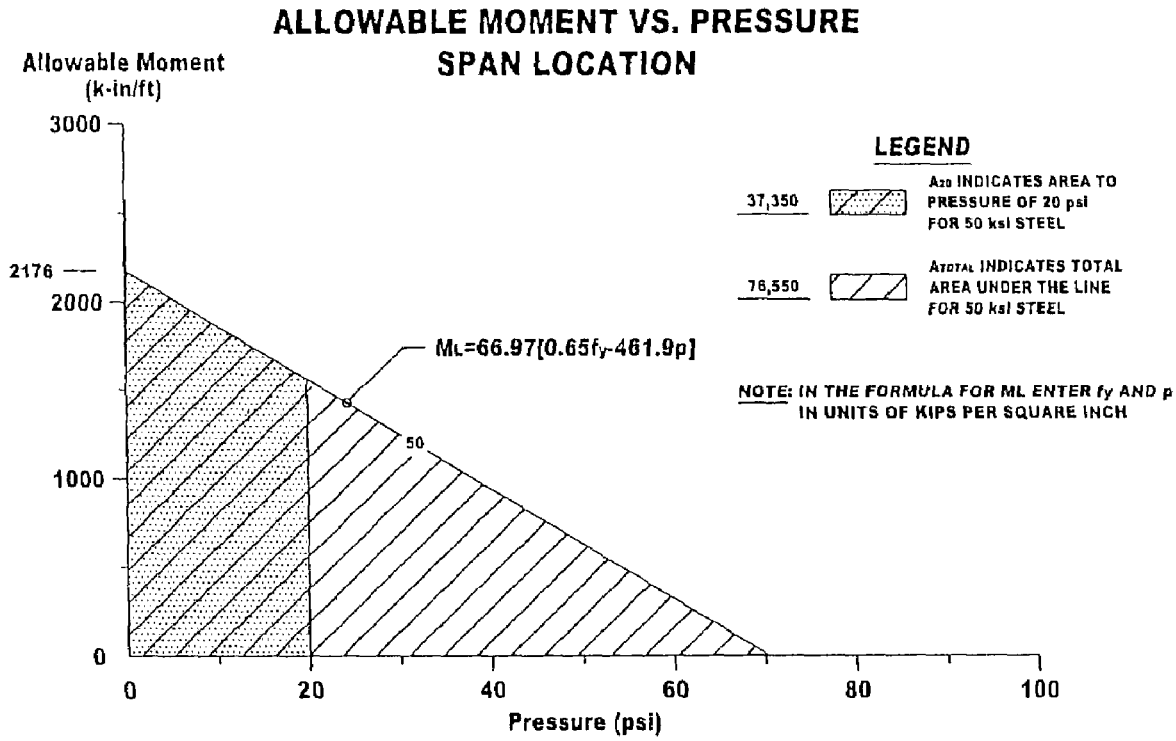
FIG. 26 plots the allowable moment of the sixth embodiment of the improved piling versus applied pressure at the span location.

In this second general embodiment, as shown in FIGS. 12 and 14, surface 49 is generated about two center points, indicated at 57*a* and 57*b*. Surface 49 is thus defined by two inner radii, indicated at 25*a* and 25*b*. Surface 49 thus comprises a first arc distance from 62*b* to 76 of a cylinder having a radius 25*a* and a second arc distance from 76 to 62*a* of a cylinder having a radius 25*b*.

Point 57*a* is located at the intersection of imaginary line 53*a* and radius 25*a*. Line 53*a* extends perpendicular to web surface 40 at tangent point 62*b*. It also can extend from tangent point 76, the point at which the curvature of surface 49 changes from being defined by radius 25*a* to being defined by radius 25*b*. Point 57*b* is located at the intersection of imaginary line 53*b* and radius 25*b*. Line 53*b* extends perpendicular to flange surface 41 at tangent point 62*a*. Tangent point 62*a* is located at the intersection of surface 41 and arcuate surface 49, which is the point at which the inner surface 41 of flange 18 begins to bend towards web surface 40. Similarly, tangent point 62*b* is located at the intersection of surface 40 and surface 49.

As shown in FIG. 12, the plane of inner flange surface 41 and of web surface 40, respectively, may be extended into junction 21 to imaginary intersection point 64. Arcuate surface 49, which is in turn defined by radii 25*a* and 25*b*, the extension 40*a* of web surface 40, and the extension 41*a* of inner flange surface 41, define fillet 48.

The structural dimensions and the data from the finite analysis, as more fully shown in FIGS. 23–26, of these two specific embodiments are summarized in following charts A5–A6 and B5–B6, respectively.

CHART A5

| PZC31.8- Physical Characteristics | |
|---|---|
| Weight | 31.8 psf |
| Moment of Inertia | 397.9 $in^4/ft$ |
| Section Modulus | 48.5 $in^3/ft$ |
| Web Angle | 58.6 degrees |
| First Junction Inner Radii | |
| a. radius 1 (web) | 10 in |
| b. radius 2 (flange) | 0.833 in |
| First Junction Outer Radius | 1.125 in |
| Second Junction Inner Radii | |
| a. radius 1 (web) | 10 in |
| b. radius 2 (flange) | 0.833 in |
| Second Junction Outer Radius | 1.125 in |
| First Flange Thickness | 0.56 in |
| Second Flange Thickness | 0.56 in |
| Web Thickness | 0.46 in |
| Cross-Sectional Area | 19.5 $in^2$ |
| Distance from Centroid to the First Flange Outer Surface | 8.21 in |
| Distance Between the First Flange Outer Surface and the Second Flange Outer Surface | 16.42 in |

CHART B5

| PZC31.8- Strength | |
|---|---|
| Transverse Stress at Wale Location between 0 and 47.04 psi | 691.1 psi per psi applied pressure |
| Transverse Stress at Span Location between 0 and 31.68 psi | 546.7 psi per psi applied pressure |
| Total Area Under Curve at Wale Location | 39,600 |
| Area Under Curve between 0 psi and 20 psi at Wale Location | 26,450 |
| Total Area Under Curve at Span Location | 14,350 |
| Area Under Curve between 0 psi and 20 psi at Span Location | 26,200 |

CHART A6

| PZC39.7- Physical Characteristics | |
|---|---|
| Weight | 39.7 psf |
| Moment of Inertia | 614.1 $in^4/ft$ |
| Section Modulus | 67 $in^3/ft$ |
| Web Angle | 71.5 degrees |

CHART A6-continued

| PZC39.7- Physical Characteristics | |
|---|---|
| First Junction Inner Radii | |
| a. radius 1 (web) | 10 in |
| b. radius 2 (flange) | 0.833 in |
| First Junction Outer Radius | 1.2 in |
| Second Junction Inner Radii | |
| a. radius 1 (web) | 10 in |
| b. radius 2 (flange) | 0.833 in |
| Second Junction Outer Radius | 1.2 in |
| First Flange Thickness | 0.6 in |
| Second Flange Thickness | 0.6 in |
| Web Thickness | 0.505 in |
| Cross-Sectional Area | 20.8 $in^2$ |
| Distance from Centroid to the First Flange Outer Surface | 9.170 in |
| Distance Between the First Flange Outer Surface and the Second Flange Outer Surface | 18.3 in |

CHART B6

| PZC39.7- Strength | |
|---|---|
| Transverse Stress at Wale Location between 3.96 and 60.23 psi | 539.6 psi per psi applied pressure |
| Transverse Stress at Span Location between 0 and 70.35 psi | 461.9 psi per psi applied pressure |
| Total Area Under Curve at Wale Location | 69,850 |
| Area Under Curve between 0 psi and 20 psi at Wale Location | 38,550 |
| Total Area Under Curve at Span Location | 76,550 |
| Area Under Curve between 0 psi and 20 psi at Span Location | 37,350 |

By selectively modifying the amount and distribution of steel at the junction with a two or three radii design, it has been found that a substantial increase in the allowable moment as a function of pressure is obtained, especially with respect to the reduction of transverse stresses.

The present invention contemplates that many changes and modifications may be made. Therefore, while the presently-preferred forms of the Z-shaped piling has been shown and described, those skilled in this art will readily appreciate that various additional changes and modifications may be made without departing from the spirit of the invention, as defined and differentiated by the following claims.

What is claimed is:

1. A sheet piling comprising;

a first flange;

a second flange;

a web;

a junction between said first flange and said web;

said junction having a substantially concave inner surface;

said inner surface comprising at least a first concave surface of a first radius, a second concave surface of a second radius and a third concave surface of a third radius; and said second radius being different from said first radius.

2. The sheet piling of claim 1, wherein said third radius is different from said first radius.

3. The sheet piling of claim 2, wherein said third radius is different from said second radius.

4. The sheet piling of claim 1, wherein said third radius is substantially the same as said first radius.

5. The sheet piling of claim 4, wherein said second concave surface is between said first concave surface and said third concave surface.

* * * * *